United States Patent [19]

Meier et al.

[11] 4,237,807

[45] Dec. 9, 1980

[54] THREAD MONITORING DEVICE FOR THE THREAD SUPPLY OF A ROTARY HOOK OF A SEWING MACHINE

[75] Inventors: Günter Meier, Karlsruhe-Durlach; Patrice Kemmel, Stutensee-Friedrichstal, both of Fed. Rep. of Germany

[73] Assignee: Dorina Nähmaschinen GmbH, Fed. Rep. of Germany

[21] Appl. No.: 76,380

[22] Filed: Sep. 17, 1979

[30] Foreign Application Priority Data

Sep. 15, 1978 [DE] Fed. Rep. of Germany ... 7827499[U]

[51] Int. Cl.[3] ..... G01B 7/12; D05B 69/36

[52] U.S. Cl. ..... 112/278; 112/273; 250/571; 139/273 A

[58] Field of Search ..... 112/278, 273; 139/273 A; 250/561, 571

[56] References Cited

U.S. PATENT DOCUMENTS 3,082,968 3/1963 Reichelt et al. ..... 112/278 X 3,599,586 8/1971 Newman ..... 112/278

3,845,320 10/1974 Winberg ..... 139/273 A X

*Primary Examiner*—Peter P. Nerbun

*Attorney, Agent, or Firm*—McGlew and Tuttle

[57] ABSTRACT

A thread monitoring device for monitoring the thread supply in a sewing machine, having a rotary hook, comprises, a hook body with a thread bobbin having thread thereon which is connected to a rotatable shaft for rotation thereby. The hook includes a stationary bobbin case which is enclosed by a hook body which has a hub portion connected to the shaft. A light source is disposed on one side of the hook and a light receiver is disposed on the opposite side. Light is transmitted by the light source through a path intercepting the thread on the bobbin so that, when the thread on the bobbin is paid out during the stitching operation, beyond a predetermined amount, the light will be transmitted to a reflective wall portion of the hook body and deflected by the wall portion to the light receiver. The light receiver is connected in a control circuit to operate a control for operating the sewing machine or for actuating an indicator to show that the thread has been used up to the predetermined amount.

9 Claims, 3 Drawing Figures

THREAD MONITORING DEVICE FOR THE THREAD SUPPLY OF A ROTARY HOOK OF A SEWING MACHINE

FIELD AND BACKGROUND OF THE INVENTION

This invention relates to sewing machines in general and, in particular, to a new and useful thread monitoring device for monitoring the thread supply in a sewing machine which has a rotary hook and which includes a light source directing light through a path intercepting the thread so that when the thread is used up, it passes beyond the position of the thread to a control device to actuate the control device.

DESCRIPTION OF THE PRIOR ART

Thread supply monitors are known which have appropriate openings in the bobbin and hook for optical scanning of the under thread supply. Especially in the case of optical scanner arrangements, it is necessary to place the light source and the light receiver close enough to the scanning point to ensure a sufficiently strong, and because of the danger of interfering fuss, sufficiently exact optical observation of the thread supply on the bobbin. In a known arrangement, therefore, the hook shaft is pierced to create a light channel. However, this possibility does not bring the light source very close to the hook, and this is only feasible with a hook construction in which the bobbin is arranged extremely eccentric to the hook axis.

SUMMARY OF THE INVENTION

The purpose of the present invention is to eliminate the above described disadvantages, since with the inventive arrangement, it is possible to bring both the light source and the light receiver close to the hook, so as to exclude the greatest possible number of disturbing factors.

The invention includes means for deflecting the light beam within the hook in such a manner that the emitter and receiver can be disposed directly on the outside of the hook. For this purpose, a part of the hook is designed as a deflection surface for the light beam. The hook body is advantageously provided with an aperture. The wall of the aperture extends, at least partially at an angle to the axis of the hook, and forms the deflection surface. The deflection surface may be polished in order to avoid dispersion of light.

For bobbin changes, the part of the under thread supply display (light source or light receiver) which is disposed just before the front of the hook must be removable from its location. This part, therefore, is advantageously mounted pivotably and is coupled with the housing flap covering the hook. In a particularly simple design of the invention, the portion disposed in front of the hook (light source or light receiver) is secured to the housing flap itself.

In accordance with the invention, there is provided a thread monitoring device for monitoring the thread supply in a sewing machine having a rotary hook and, wherein, the hook includes a wall portion deflecting light from a light source arranged on one side of the hook at an angle to the axis of the hook so that it is received by a light receiver which operates a control circuit for indicating the thread condition or for actuating the sewing machine.

A further object of the present invention is to provide a thread monitoring device for a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference is made to the accompanying drawing and descriptive matter in which a preferred embodiment of the invention is illustrated.

DESCRIPTION OF THE PREFERRED EMBODIMENT

Figure 1:
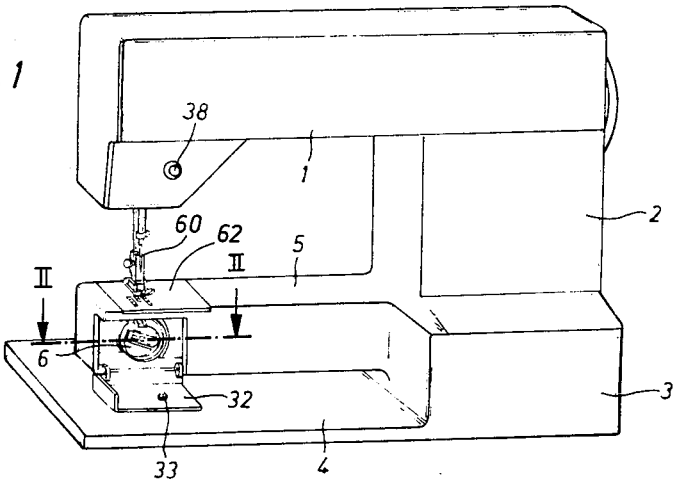
FIG. 1 is a front side perspective view of a sewing machine constructed in accordance with the present invention.

Referring to the drawing in particular, the invention embodied therein, comprises, a device for monitoring the thread supply in a sewing machine which has a rotary hook, generally designated 6, having a thread supply on a thread bobbin 11 which is fed by rotation of the hook into cooperation with a reciprocating needle 60, of the sewing machine which advances thread through a workpiece positioned on a plate support 62 thereof.

The sewing machine shown in FIG. 1 comprises an upper arm 1 connected through a standard or column 2 with a lower arm or pedestal 3. Pedestal 3 is supported by, or includes, a bottom plate portion 4 and is equipped with a work support arm 5 in which the lower stitch forming tools, in particular, a rotary hook 6, are mounted.

Figure 2:
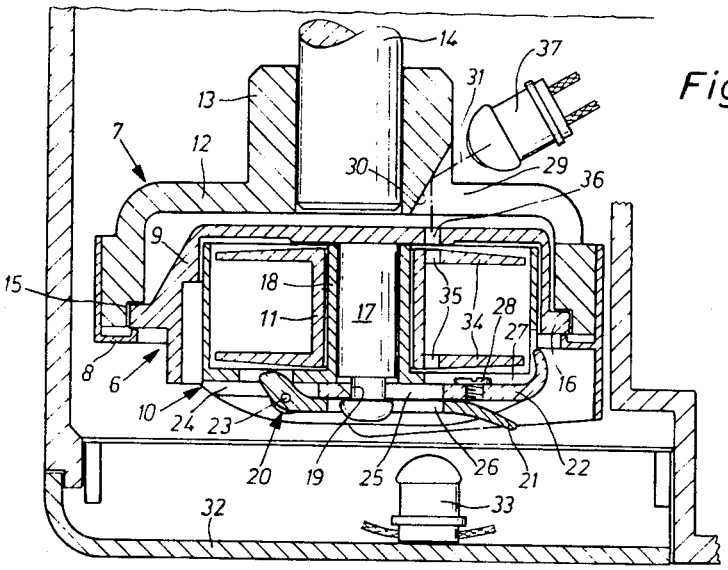
FIG. 2 is an enlarged horizontal sectional view taken along the line II—II of FIG. 1.

The rotary hook 6 in FIG. 2 consists of a hook body 7 and a hook plate 8, which together form the revolving part of hook 6, and further consists of a bobbin case gib plate 9 and a bobbin case 10, which together form the stationary part of the hook and receive the thread bobbin 11. Under thread is spooled on bobbin 11 in a known manner and the thread cooperates with the needle thread to form the seam during the stitch formation.

The hook body 7 comprises a bottom portion 12 which is connected with a hub portion 13 for attachment of the hook 6 on a hook shaft 14 mounted in the work support arm 5 and is rotatably driven in a manner known per se. An annular milled recess 15 is provided in the hook body 7 which together with the wall of the hook plate 8 contiguous thereto, forms a runway for a bearing rib 16 which is provided on the gib plate 9. A pin 17 extends outward from the center of the bottom of the gib plate 9 and receives a concentric sleeve 18 forming a part of the bobbin case 10. Pin 17 has an annular groove 19 near its outer end, with which a lock 20, provided on the bobbin case 10, cooperates.

Lock 20 is provided with a flap lever 21 which is connected with a slide 22 through a hinge pin 23. Slide 22 is displaceably mounted in a guideway 24 in the bobbin case 10. In addition, the slide has an opening 25 whose edge engages in the annular groove 19 of pin 17 when the flap lever 21 is flapped in. Flap lever 21 also has an opening 26 in which the end of pin 17 places itself. Moreover, a radial slot 27 is provided in the bottom of the bobbin case 10 for the free movement of a limiting screw 28 fastened in slide 22.

Hook body 7 is provided with an opening 29 having a wall portion 30 in the region of hub 13 defining a deflection surface for a light beam 31. To this end, the deflection surface 30 extends at an angle to the axis of the hook 6 and it advantageously comprises a polished surface. The light beam 31 is emitted by a light source 33 which is disposed directly in front of the hook 6 on the inside of a housing flap or cover 32 pivotally mounted on the work support arm 5.

The thread bobbin 11, equipped with flanges 34, has a plurality of axis-parallel bores 35 arranged in pairs at the point of origin of flange 34. Moreover, the bottom of the gib plate 9 is provided with a slot 36 which is aligned with the openings 25 and 26 in slide 22 and in flap lever 21 as well as with the radial slot 27 in the bobbin case 10. Bore 35, slot 36, radial slot 27 and the openings 25 and 26 are formed and arranged relative to each other in such a way that the light beam 31 emitted by the light source 33 can, in a certain angular position of hook 6, pass thorugh them parallel to the axis as soon as the bores 35 in bobbin 11 and, hence, also slot 36 in the gib plate 9 are not covered by under thread. The light beam 31 is then deflected on the deflection surface 30 and sent to a light receiver 37 which is secured directly behind hook 6 in the region of the free space between bottom 12 and hub 13 of hook body 7 on the work support arm 5.

An indicating diode 38 having a flashing operation is disposed on the outside of the upper arm 1, in the field of vision of the operator of the sewing machine. The flashing of the diode indicates expiration of the under thread in bobbin 11.

Figure 3:
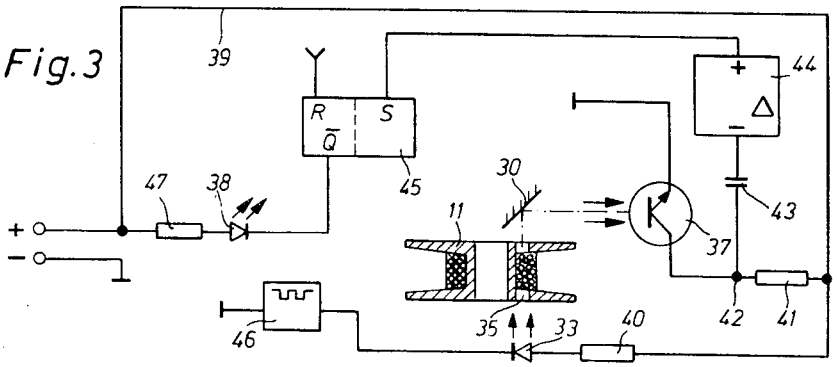
FIG. 3 is a schematic circuit diagram for the control of the thread supply monitor.

FIG. 3 of the drawing shows a simplified circuit diagram of the electrical components required for the operation of the light source 33, deflection surface 30, light receiver 37 and indicating diode 38.

From the positive pole of a voltage source, current flows through a line 39 and a resistor 40 to the light source 33, which may consist of a diode-emitting infrared light, operated in pulsations through a blinker pulse generator 46. The light receiver 37, designed as a phototransistor, is connected to line 39 via a series-resistance 41 and a junction 42. A capacitor 43 is clamped to the junction 42, which is connected to the set input S of a flip-flop memory 45 via a threshold amplifier 44. The reset input R of memory 45 is connected to an arrangement (not shown) which supplies a reset pulse to it upon start-up of the motor (not shown) of the sewing machine.

The output $\overline{Q}$ of memory 45 is connected to the indicating diode 38, which is applied to the positive pole of the voltage source via a series-resistance 47.

The device operates as follows:

During sewing, the revolving part of hook 6 rotates in a known manner with the hook shaft 14, while its stationary parts 9 and 10 are retained by a holding piece (not shown). The light source 33, which is supplied with current through line 39, resistor 40 and blinker pulse generator 46, sends a sharply focused, pulsating light beam 31 through the two openings 26 and 25 in lock 20 and through the radial slot 27 in the bottom of the bobbin case 10. When there is enough under thread in bobbin 11, the bobbin's bores 35 and the slot 36 in the bottom of the gib plate 9 are covered and further passage of light beam 31 through hook 6 is prevented.

However, as soon as the under thread supply on bobbin 11 has decreased to the extent that light beam 31 can pass at least partially through the bores 35 and, hence, through slot 36 in the bottom of the gib plate 9, the beam is guided onto the deflection surface 30 in hub 13 of the hook body 7; is deflected there, and is received by light receiver 37. As soon as a sufficiently great pulsation of light beam 31 impinges on light receiver 37, the latter becomes conductive and discharges capacitor 43, which had previously been charged through the series resistance 41. As soon as the discharge pulse exceeds the set threshold of the threshold amplifier 44, i.e., the under thread supply has dropped below a certain value, amplifier 44 sends a signal to the set input S of flip-flop memory 45. Thereby, the latter is set, so that diode 38 lights up. The latter remains connected to voltage until after the bobbin 11 has been filled with a new thread supply and the motor has been operated to bring the under thread up. A signal triggered by the motor on the reset input R then throws switch 45 over, so that current supply to the indicating diode 38 is cut off.

Whereas the openings 25 and 26 of lock 20, as well as the radial slot 27 of the bobbin case 10 and slot 36 of the gib plate 9 always remain in the region of lightbeam 31, the bores 35 revolve during unwinding of the under thread from bobbin 11, as does also the slot 29 during the revolution of the hook body 7, independently of each other, so that the triggering of an indicating pulse requires a certain sewing time. As the indicating pulse is only triggered when both the aperture 29 and the bores 35 happen to be in the region of the light beam 31, the response period after a predetermined quantity of thread has been used up may vary somewhat. However, with a sufficient number of pairwise-arranged bores 35 in the bobbin and with the small amount of thread used for the stitch formation, the magnitude of the response interval of the under thread supply indication is not appreciable.

For bobbin change, the housing flap 32 on the work support arm 5 is opened or dropped down and, at the same time, the light source 33 which is connected with the flap is taken out of the region of hook 6. By swinging lever 21 down, slide 22 is moved out of the annular groove 19 of pin 17, so that the bobbin case 10 can be taken out of the gib plate 9 together with bobbin 11.

Bobbin 11 may be made of a transparent material and, in that case, the bores 35 are not absolutely necessary. The triggering of the response range of the under thread supply indication is then determined by the dimension of slot 36 in the bottom of the gib plate 9. To avoid light loss due to scratched surface of the flanges 34 of bobbin 11, it may then be expedient to provide cylindrical blind holes whose bottom faces lie below the surface of the flanges 34 and, therefore, outside of the area of wear, instead of the bores 35.

Instead of the indicating diode 38 functioning as an indicating means, or coupled with it in a suitable manner, there may be provided, in addition, control means which automatically stop the motor drive.

Naturally, it is also possible to interchange the arrangement of the position of the light source 33 and of the light receiver 37.

While a specific embodiment of the invention has been shown and described in detail to illustrate the application of the principles of the invention, it will be understood that the invention may be embodied otherwise without departing from such principles.

What is claimed is:

1. A device for monitoring a thread supply in a sewing machine having a rotary hook, comprising, a light source which emits a light beam directed approximately parallel to the axis of the hook and passes through a path taking it through the supply of thread on the hook bobbin, a light receiver disposed in a position to receive light after it passes through the thread and wherein said hook includes a portion thereof defining a deflection surface deflecting the light beam from the axis of the hook into the light receiver after it passes through the thread supply.

2. A device as claimed in claim 1, wherein said hook includes a body portion having an aperture therethrough and with a wall bounding the aperture disposed at an angle to the axis of the hook forming the deflection surface.

3. A device as claimed in claim 2, wherein said deflection surface is polished.

4. A device as claimed in claim 1, including a flap pivotally closing a portion of the sewing machine housing the hook, said light source being mounted on said flap for movement therewith.

5. A device as claimed in claim 4, wherein said hook comprises a bobbin upon which the thread is wound, having an opening therethrough for the passage of light through the opening of each side thereof, said opening being covered by thread when the bobbin is filled and being opened by the thread when it is paid out by a predetermined amount.

6. A thread monitoring device for a rotary hook which is connected to a rotatable shaft and has a bobbin with thread thereon which is fed off for cooperation with a reciprocating needle to form a thread stitch, comprising, a hook body connected to the rotatable shaft for rotation therewith, a stationary bobbin case enclosing said bobbin and being disposed at one side of said hook body, a light source disposed on one side of said bobbin case and said hook body and producing an axially directed light beam, light receiver means disposed on the opposite side of said bobbin case body and said hook body from said light source and offset axially therefrom, said hook body having a light transmissive portion and a light deflective portion disposed in the path of said light beam on the opposite side of the bobbin from said light source, the thread on said bobbin normally intercepting said light source but being paid out to a point at which the light source passes therethrough, said deflecting surface acting to deflect the light which is transmitted through said bobbin at an angle to its original path to said receiver, said light receiver means including a control which is responsive to light received by said receiver means.

7. A thread monitoring device, as claimed in claim 6, wherein said light receiver means includes a flasher indicator and an electrical circuit connected to said indicator and to said light receiver for maintaining said indicator in a flashing condition until said bobbin is removed.

8. A thread monitoring device, as claimed in claim 6, wherein said bobbin case includes a housing having an opening on each side located on respective sides of said bobbin, said bobbin having an opening therethrough on each side of said bobbin, all of said openings being alignable for the passage of light therethrough when the thread does not cover the openings.

9. A thread monitoring device, as claimed in claim 8, wherein said hook body includes a flange portion covering one side of said bobbin case, having a hub portion connectable to the shaft, said flange portion having an opening therethrough for the passage of light and including a wall portion bounding the opening disposed at an angle to the axis of said hook and defining the deflective surface.

* * * * *